United States Patent [19]

Ames

[11] Patent Number: 4,489,847

[45] **Date of Patent: * Dec. 25, 1984**

[54] PARROT-BEAKABLE FREESTANDING PLASTIC DRUM ASSEMBLAGE

[75] Inventor: Geoffrey C. Ames, Toledo, Ohio

[73] Assignee: Owens-Illinois, Inc., Toledo, Ohio

[ * ] Notice: The portion of the term of this patent subsequent to May 20, 1997 has been disclaimed.

[21] Appl. No.: 224,582

[22] Filed: Jan. 12, 1981

Related U.S. Application Data

[63] Continuation of Ser. No. 876,081, Feb. 8, 1978, Pat. No. 4,294,374, which is a continuation of Ser. No. 636,272, Nov. 28, 1975, abandoned.

[51] Int. Cl.[3] ..... B65D 1/46; B65D 6/34; B65D 25/22

[52] U.S. Cl. ..... 220/71; 220/5 R; 220/69; 220/73; 220/85 P; 220/94 R; 220/DIG. 1

[58] Field of Search ..... 220/5 R, 5 A, 69, 71, 220/73, 85 P, 366, DIG. 1

[56] References Cited

U.S. PATENT DOCUMENTS

| | | | |
|---|---|---|---|
| 1,441,674 | 1/1923 | Foster | 220/DIG. 1 |
| 3,143,243 | 8/1964 | Mackusick | 220/69 |
| 3,294,231 | 12/1966 | Armbruster | 220/5 R |
| 3,370,737 | 2/1968 | Ainslie | 220/5 R |
| 3,613,938 | 10/1971 | Westcott | 220/366 |
| 3,840,141 | 10/1974 | Allom | 220/DIG. 1 |

FOREIGN PATENT DOCUMENTS

| | | | |
|---|---|---|---|
| 600094 | 3/1948 | United Kingdom | 220/73 |
| 847354 | 9/1960 | United Kingdom | 220/85 P |

*Primary Examiner*—George E. Lowrance
*Attorney, Agent, or Firm*—Thomas L. Farquer; M. E. Click

[57] ABSTRACT

There is provided a plural part receptacle assemblage for the storage and handling of bulk quantities of material which assemblage includes a tight-head plastic drum molded as a single article to which is concentrically attached, subsequent to the formation of the drum, handling means so arranged and constructed as to be grippable about substantially the full 360° circumference of the drum with steel drum chime-handling devices for transportation of the assemblage and the bulk quantities of material stored in the drum; preferably the drum or handling means, or both, include means for preventing liquid accumulation between the handling means and drum.

8 Claims, 12 Drawing Figures

PARROT-BEAKABLE FREESTANDING PLASTIC DRUM ASSEMBLAGE

This application is a continuation of Ser. No. 876,081, filed Feb. 8, 1978, now U.S. Pat. No. 4,294,374, which in turn is a continuation of Ser. No. 636,272, filed Nov. 28, 1975, now abandoned.

THE INVENTION

The present invention is directed to the art of materials handling and more particularly is directed to freestanding plastic drums. Even yet more particularly the invention is directed to a plural part assembly of a plastic tight-head drum fabricated of an organic polymer and a fitment assembled to the drum which allows the drum to be handled with conventional steel drum chime-handling devices.

Steel drums were generally the first successful drum utilized for purposes of handling, storing, and transporting bulk quantities of materials, for example, quantities of material, on a volume basis, on the order of at least about 30 gallons and more typically on the order of about 50 to 60 gallons. The drum most commonly employed has a nominal volume of approximately 55 gallons. Because of the long and wide spread usage of steel drums conventional mechanical equipment has been developed to handle them. This equipment for handling steel drums may be divided into two general categories. One of these categories is equipment generally designed to handle steel drums along the rolling hoops which are provided in the sidewalls of the drum. The other category of standard equipment which has been developed is generally referred to as steel drum chime-handling devices; these devices are adapted to handle the drum by gripping the upper chime thereof. These steel drum chime-handling devices generally take the form of having a hook or claw which grips the chime for appropriate movement and transportation. In the art these types of chime-handling equipment are variously referred to as parrot-beak devices, or occasionally as a cherry picker, chime grabbers, and hand trucks. The former type of chime-handling device, i.e., a parrot-beak, or cherry picker is represented by the device sold by Little Giant Company under the designation "Grip-O-Matic". This device in addition to a lower anti-pivot support surface includes two opposed movable jaws, or beaks, which when brought into contact with a chime are adapted to open so as to allow them to be positioned with the chime between them and, upon lifting of the drum, the chime is lockingly gripped between the jaws or beaks allowing convenient movement and transportation; these jaws then automatically release as the drum is set down in its desired location. As is the case with a parrot-beak the other steel drum chime-handling devices likewise employ beaks, or jaws, or hooks, to exert a localized force on the chime which allows for the steel drum to be tilted and appropriately moved. Because the steel drum handling devices have been standardized for steel drum movement they generally function well for their intended purposes.

More recently, however, freestanding tight-head plastic drums have been made available but unfortunately these drums have not yet obtained their full potential. It will be appreciated that such drums, and especially those which are molded as a single piece article offer many highly desirable characteristics. Some of these desirable characteristics include, for example, low price, low shipping costs, a wide scope of product applications without the need for liners, high resistance to the detrimental influence of weather, lightweight, rust resistance, dent resistance, and in general they are highly aesthetically pleasing. A primary deterrent to the wider acceptance and usage of freestanding plastic drums, and especially tight-head plastic drums which are molded, for example blow molded, as a single piece article has largely been that conventional steel drum chime-handling devices cannot conveniently and interchangeably be employed with plastic drums and steel drums for movement and expeditious handling of both. Thus there is a problem which needs a solution and a need exists in the art for providing a plastic drum having all the desirable characteristics indicated above which drum can also be handled for movement and transportation with conventional steel drum chime-handling devices. This need, and the solution of this problem, is especially acute with regard to tight-head plastic drums which are formed by blow molding as a single piece article and are fabricated entirely of the same material. These tight-head, single piece molded plastic drums have all of the desirable characteristics indicated above and furthermore they are conveniently and economically produced by a blow molding operation, for example, in an operation wherein a tubular member is blown to the desired drum configuration.

Thus it becomes the general object of this invention to provide for a tight-head plastic drum, especially one which is molded as a single piece, which can be handled with conventional steel drum chime-handling devices and especially parrot-beak devices. This is generally accomplished by providing a receptacle assembly, i.e., a receptacle which is put together, or assembled, from two completed units, namely a prefabricated tight-head drum, especially one molded as a single piece article, and an attachment, or fitment, which is grippable by steel drum chime-handling devices, e.g. parrot-beaks. The attachment is put on, the prefabricated tight-head drum in a durable manner concentrically about the drum and is substantially circumferential, thereby distributing the load on the drum over a wide area and alleviating problems with breakage or rupturing of the drum proper. Additionally in passing it should be mentioned that the fitment, or attachment, is so located on the drum and so arranged and constructed that the strong localized gripping forces exerted by the chime-handling devices, for example the pinching and gripping forces exerted by the edges of opposed beaks of parrot-beak devices, are not localized on the plastic drum proper. This is a highly advantageous feature of the present invention in that, should a weakness develop at the points of contact by the jaws or beaks of the chime-handling devices, the potential puncturing, will be of the fitment, or attachment; itself and not a puncturing of the drum with the unacceptable exposure of the contents. This protection against drum puncturing and exposure of the contents is attained by use of an attachment, or handling means, which is independent and separate of the plastic drum per se and of any means used to attach a head to a body to form a plastic drum. Other highly desirable features which are provided by this invention are that the receptacle assemblies can be easily stacked and the provided handling means functions in the manner of a shock absorber to substantially eliminate possible damage to the drum proper. Additionally in a highly important embodiment the handling means are removably assembled onto the drum; thus should damage result to the handling means, as for example might occur when it absorbs a strong sudden force, such damaged means can be easily separated from the assembly and the drum salvaged. This interchangeability of parts of course provides for great economic premiums. In another important embodiment of this invention the receptacle assembly is provided with a drainage feature to prevent the accumulation of liquids between the drum proper and the handling means; the desirability, safety and advantages of such a drainage feature will be readily apparent to those skilled in the art.

Gebrauchsmuster 74 120 47 contemplates a drum in which injection molded rings are inserted during a drum molding operation. There is no recognition however in the German Gebrauchsmuster 74 120 47 of an assembly as contemplated herein wherein handling means are assembled to an already formed plastic drum. The difficulties of inserting rings into the mold during blow molding will be readily apparent to those skilled in the art as well as the deficiencies thereof such as, for example, a longer blowing cycle which greatly increases the costs of the final drum. Similarly, because of the permanent attachment of the rings interchangeability of parts is not possible. Another drum of the prior art involves formation by a method whereby a body and lid are formed separately and then joined by spin welding in order to form a sealed tight-head drum. As will be readily apparent these drums are not entirely satisfactory since they are subject to leakage at the seams. Furthermore the attempted gripping of the top of such drums such as, for example, by a parrot-beak device causes a situation wherein the localized forces of the opposed edges of the beaks of such a device may cause the drum itself to puncture thereby exposing its contents.

Proposals have also been made in the prior art for employing a small flexible loop, or a receptacle, associated with the bung to allow, for example, the hook of a hand truck to engage same. See U.S. Pat. No. 3,889,839. Neither of these proposals are satisfactory because the loop and receptacle are not concentrically disposed about the drum coaxial with the drum axis to allow an approach thereof through substantially 360° and likewise these proposals result in the exertion of severe forces on small localized areas which makes the bung highly susceptible to rupture and puncturing.

German Pat. No. 2,008,111 and U.S. Pat. No. 3,851,788 discloses plastic drums but they have no recognition of an assembly as contemplated herein using an attachment which is grippable for example by a parrot-beak device and wherein such gripping does not cause any dangers to puncturing of the drum proper.

U.S. Pat. No. 1,909,028 relates to a metallic shipping and storing vessel which has protective rings or bumpers retained in permanent engagement with the vessel. The rings have an annular portion to facilitate grasping and are provided with safety features for handling with the palms of the hands. There is no description of the present invention therein nor of the many attributes thereof as mentioned above.

Thus, in accordance with one feature of this invention there is provided a receptacle for the storage and handling of bulk quantities of material, e.g. greater than about 30 gallons and typically between about 50 to about 60 gallons, which receptacle is assembled, or put together, from a prefabricated, freestanding tight-head plastic drum and prefabricated handling means. Most desirably the drum is molded as a single piece article for example by blow molding from a tubular member. The handling means is concentrically and tightly assembled to the drum coaxial with the drum axis and is so arranged and constructed as to be grippable by steel drum chime-handling devices, especially parrot-beak devices, to enable manipulation and transportation of the receptacle in a substantially upright position. Desirably the handling means and the drum will be provided with a substantially circumferential, horizontally disposed jog providing for inter-engaging surface positions. While the inter-engaging surfaces provided by the respective jog may respectively project, or extend, outwardly, i.e., away from the longitudinal axis of the drum, or inwardly, i.e., toward the longitudinal axis, it is generally preferred that the inter-engagable surface included in the drum be recessed, or intended, i.e., inwardly projecting, and the handling means inter-engagable surface also project inwardly. Additionally in order to provide a safer, cleanable receptacle, means are provided either integral with the drum or the handling means, or both, which are adapted and constructed to prevent the accumulation of liquids between the steel drum chime-handling means and the drum. According to an especially important embodiment of this invention the handling means will be removably assembled to the drum thereby allowing for the interchangeability of various drums and the handling means. Maximized benefits of the assemblage will be obtained when the handling means projects upwardly sufficiently so that at least an upper margin thereof is generally at least flush with the upper surface of the drum, i.e., at least an upper marginal portion of the handling means will be in a plane which is at least coincident, or above; a horizontal plane defined by the upper margin of the drum. In this way stacking is facilitated and the bung area protected. In another preferred embodiment of the invention the above refer to handling means would generally be disposed as an upper portion of the receptacle and a similar member will be generally disposed adjacent the bottom of the drum which will allow and facilitate hand rolling of the drum when in an upright position and improve the stability and strength of the drum, for example, upon the receptacle being dropped, and likewise will allow for the gripping and handling of the drum by steel drum chime-handling devices when in an inverted position. Advantageously means are provided for tensioning the handling means to bring the latter into tight holding engagement with the drum and preferably the means will be releasable.

Referring to the drawings.

Figure 1:
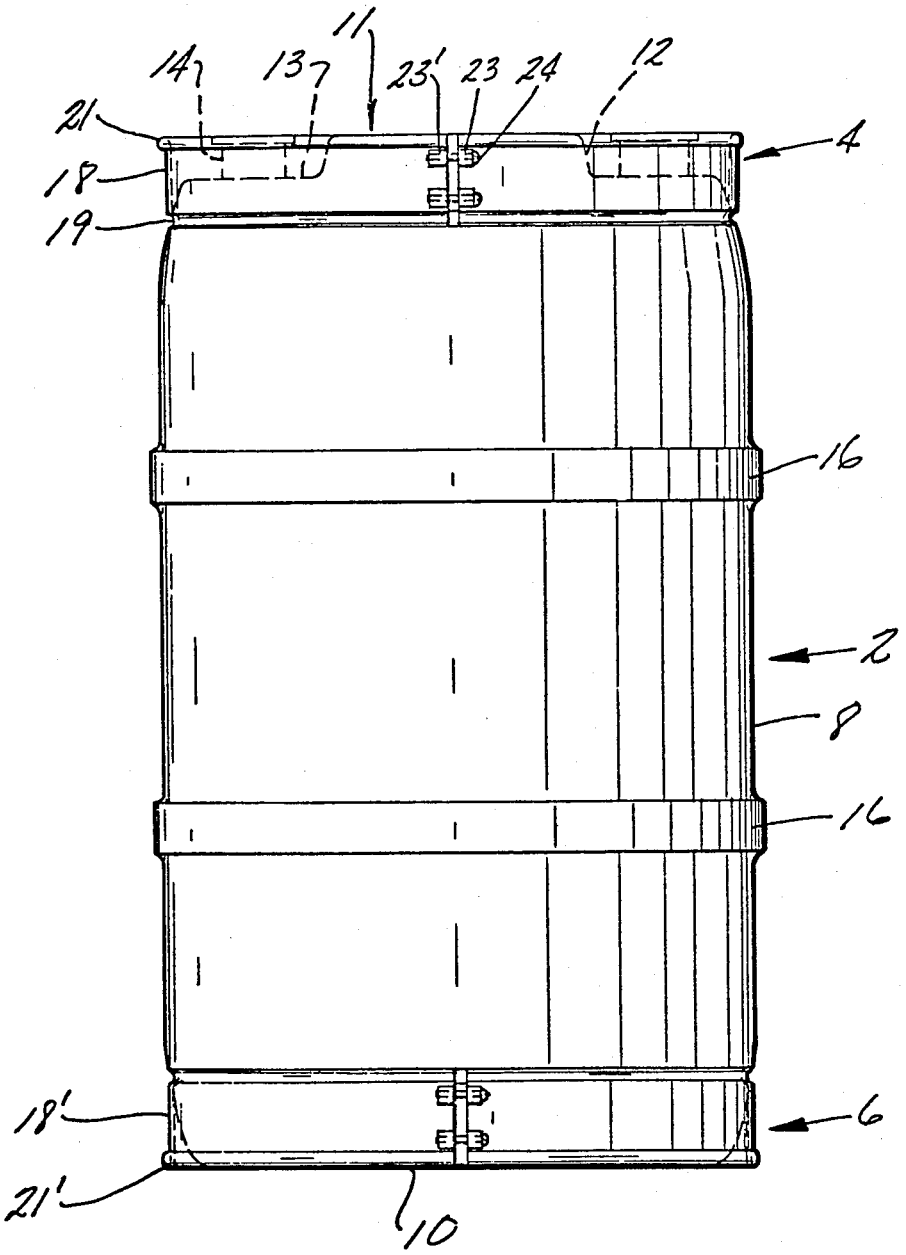
FIG. 1 is a side view of a plastic drum having upper and lower handling means assembled thereto.
Figure 2:
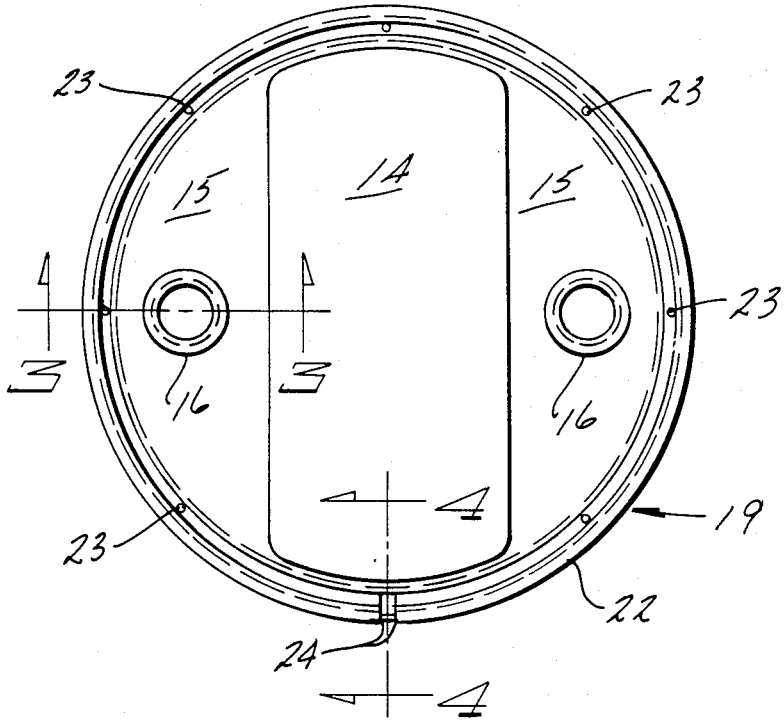
FIG. 2 is generally a top view of the drum and handling means assembly.
Figure 3:
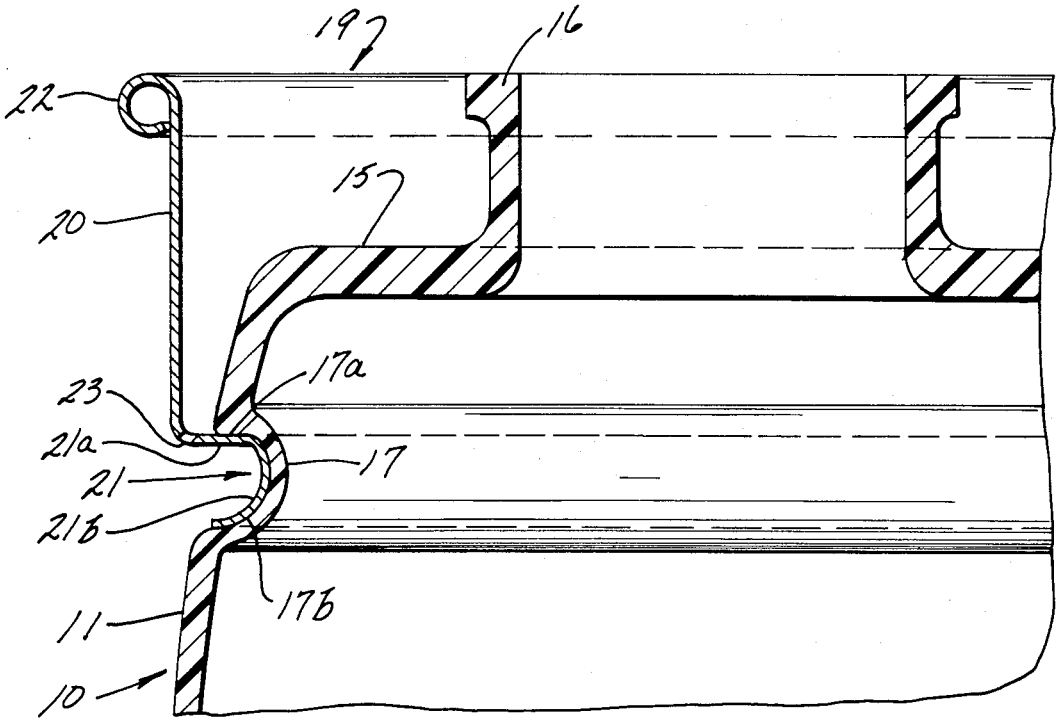
FIG. 3 is a fragmentary sectional view taken along line 3—3 of FIG. 2 more clearly showing portions of the handling means and drum and illustrating a drainage channel.
Figure 4:
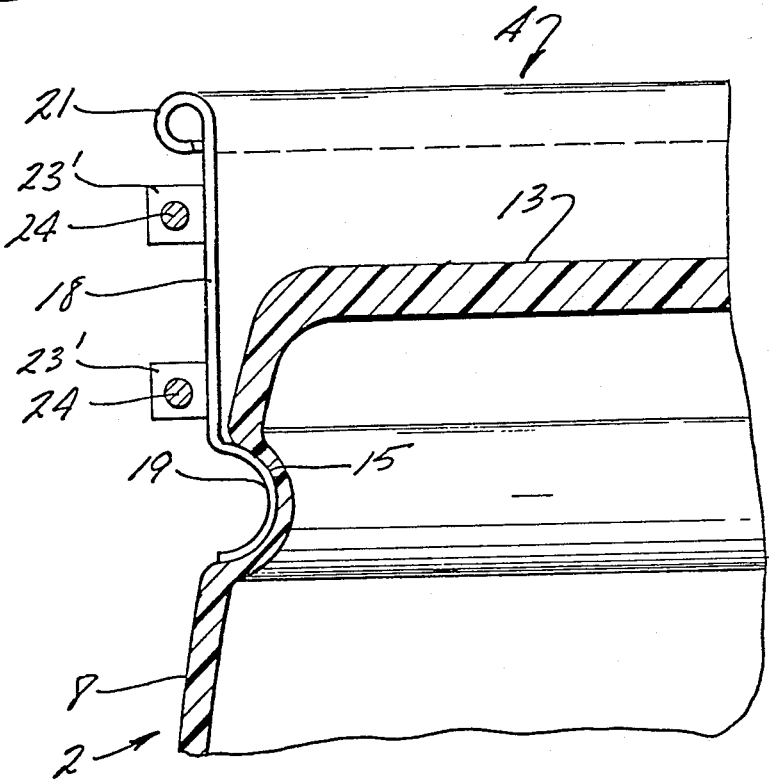
FIG. 4 is a fragmentary sectional view taken along line 4—4 of FIG. 2.
Figure 5:
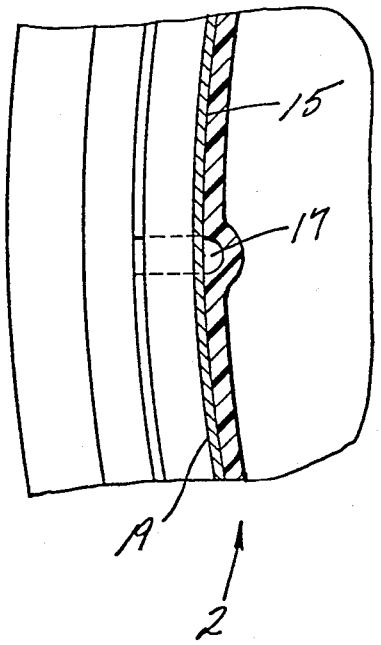
FIG. 5 is a fragmentary sectional view taken along line 5—5 of FIG. 3 more clearly showing a drainage channel.

Referring now more specifically to FIGS. 1–7 it will be seen that the plural part receptacle assembly of this invention comprises a drum 2 which drum includes at the upper portion thereof means, e.g. a collar 4, so arranged and constructed as to be grippable by steel drum chime-handling devices. Similarly, the drum includes at the bottom portion thereof means, illustrated as a collar 6 grippable by steel drum chime-handling devices when the drum is in an inverted position and which means serve to allow for rolling of the drum when it is in a substantially upright position. Drum 2 is a tight-head drum formed as a single piece article by a blow molding operation. Subsequent to the formation of this tight-hand drum, collar 4, and if desired collar 6, is subsequently assembled onto drum 2 to from the plural part assembly. Drum 2 is substantially cylindrical in shape and comprises a generally circumferential sidewall 8 which merges, with a slight taper, at its lower portion with bottom end 10. At its upper margin circumferential sidewall merges, again with a slight taper, with the top end of the drum, generally designated 11. Top end 11 includes a generally raised panel portion 12, which serves as a supporting surface, and merges with generally depressed sections 13 which inlude at least one, and preferably two diametrically opposed, upwardly extending tubular projections 14 which tubular projections define an opening into the internal zone of drum 2; i.e., tubular projection 14 defines a bung hole opening into the drum. In the preferred mode of practicing this invention the tubular projection will of course be provided with suitable closure means which are not shown but which are conventional and well known in the art. Generally it is preferred that the upper surface of tubular projection 14 and the upper surface of panel 12 be generally in about the same horizontal plane. Sidewall 8 at a location adjacent top end 11 is provided with a substantially circumferential generally horizontally disposed jog, illustrated as inwardly projecting arcuate surface portion 15. Preferably the circumferential surface portion 15 will be located about 1–3 inches below depressed section 13. As indicated arcuate projecting surface 15 is an inwardly projecting, or extending surface, or recess, but as will be apparent it could likewise be an outwardly projecting, or outwardly extending, surface. Similarly, drum sidewall 8 adjacent bottom end 10 is formed with a jog, shown as an inwardly projecting arcuate surface 15'. As will be seen substantially circumferential projecting surface portion 15, and for that matter 15', are adapted to inter-engage in a nesting manner with surfaces provided on collar 4 and collar 6 respectively. In a preferred mode drum sidewall 8 also includes outwardly projecting ribs 16 which function in the manner of rolling hoops. Additionally, and as best seen in FIGS. 4 and 5, drum sidewall 8 is preferably provided with means for preventing the accumulation of liquids between collar 4 and drum 2. These means may take the form of at least one drainage channel 17 integrally formed in projecting surface 15 in the manner of a dimple-like channel. Preferably, a plurality of drainage channels will be employed which are substantially uniformly distributed along the circumference of projecting surface 15. If desired circumferentially disposed inwardly projecting surface 15' may be provided with similar channels.

After providing the primary element, i.e, the drum, a secondary element is then put on, or assembled to, the drum to provide the handling means for the assembly. The handling means are so arranged and constructed as to be grippable by steel drum chime-handling devices, and especially the opposed jaws of parrot-beak devices, to enable manipulation, movement and transportation of the receptacle assembly, notably drum 2, in a substantially upright position. Highly advantageously the handling means are removably attached, i.e., not bonded, to the drum so that the handling means can be removed without significant structural drum damage as otherwise would result if attachment was permanent as with rivets, or chemical bonds produced by adhesives or spin welding. In the preferred embodiment collar 4 is shown as a removable split collar and means are provided, which can be released and adjusted for tensioning the collar into holding relationship with drum 2. It will be apparent that a substantially continuous removable collar could likewise be employed with the collar being brought into snug tight holding engagement with the drum by press fitting. Thus, as seen in the drawings collar 4 is a split collar and is concentrically and coaxially assembled about the longitudinal axis of drum 2. Collar 4 is generally axially elongate and includes a substantially circumferential vertically disposed wall 18 which merges at a lower margin thereof with circumferential horizontally disposed jog illustrated as an inwardly extending projection 19 of arcuate configuration. Collar 4, in addition to drainage channels 17 of drum 2, or in lieu thereof, can include at least one drainage channel 20, and preferably a plurality of drainage channels in a uniform array, to prevent the accumulation of liquids between collar 4 and drum 2. For convenience drainage channel 20 is only illustrated in FIG. 3. As seen channel 20 is preferably formed adjacent, i.e. near or at, the junction of wall 18 and projection 19. Vertical wall 18 merges at an upper margin thereof with a portion so arranged and constructed to be grippable by steel drum chime-handling devices so as to allow movement and transportation of the receptacle. In a preferred embodiment this portion is a chime or bead-like configuration 21. As will be apparent the opposed jaws of parrot-beak devices will holdingly grip the collar with one jaw engaging the inside surface of wall 18 and the other jaw engaging the outer underside surface of bead-like portion 21. In effect that underside surface is a ledge which provides a surface which is inclined relative to the longitudinal axis of the drum so that one of the jaws can securely grip same. Any suitable configuration such as, for example, the projections provided by a denticulated upper surface portion of wall 18, may likewise be employed so long as it satisfies its purpose of being grippable by steel drum chime-handling devices, especially the jaws of parrot-beak devices.

Figure 6:
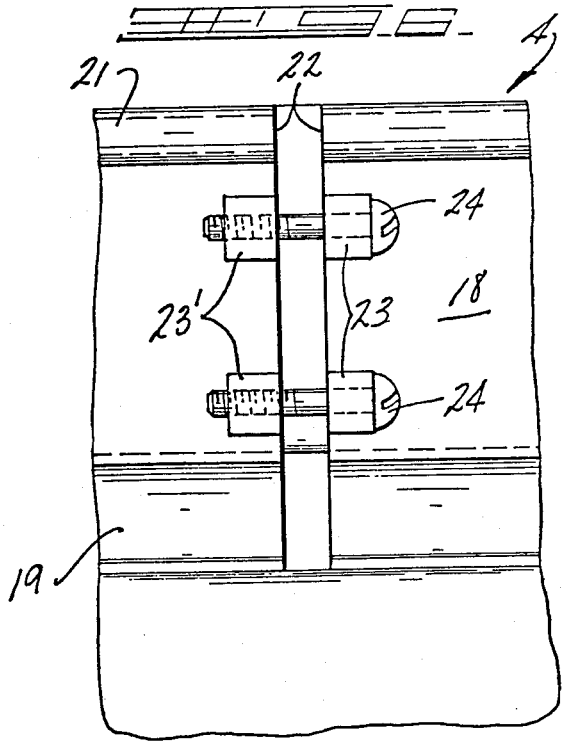
FIG. 6 is generally a partial side view more clearly indicating the handling means and adjustable means for tensioning the handling means.

Means, best seen in FIG. 6, are also preferably provided for tensioning collar 4 to bring it into engagement with drum 2 so as to maintain attachment of collar 4 to drum 2 during use. One suitable approach is to employ a set of such means axially displaced on the external surface of wall 18 respectively near the top and bottom of collar 4. Near opposed edges 22 of the opening in split collar 4, wall 18 carries both at a lower location and an upper location opposed and aligned tubular bushings 23 and 23', at least one of which (23') is internally threaded, through which a screw generally designated 24, passes. Thus a tightening of the collar to the drum is effected by tightening the screw 24, and removal of collar 4 can be effected by a loosening or release of screw 24. Another suitable approach is to locate such means on the externally disposed surface of inwardly extending projection 19 of collar 4, i.e., in the open concavity of the embodiment illustrated in FIGS. 1–6. Further durability can be obtained by using a small rod (not shown) which is inserted in the opening of the bead-like grippable portion 21 illustrated in FIGS. 1–5, which rod spans the opening between opposed edges 22 and crimping portion 21 into engagement with the rod.

In the preferred embodiment collar 4 is of a sufficient height such that its upper margin proceeds upwardly sufficiently to be at least about flush with, and desirably slightly above, the upper margin of tubular projections 14. In this way stacking is facilitated and the projections 14 protected from damage. Additionally it should be noted that the portion, e.g. bead-like portion 21, of collar 4 which is grippable by parrot-beak chime-handling devices is not part of the drum per se and so arranged and constructed such that the jaws thereof do not exert their strong localized pinching forces on the drum, thus precluding the unacceptable possibility of puncturing the drum. In the preferred embodiment collar 4 is a metal collar having a wall thickness of at least about 0.04 inches, such as, for example, sheet metal, like 16 or 8 gage low carbon sheet rolled steel.

A blow molded single piece drum of high density polyethylene having a nominal capacity of 55 gallons of the type described was tested with water. The split collar 4 was formed from 18 gage low carbon cold rolled sheet steel and the inwardly extending concave projection 19 was approximately semi-circular with a radius of about ⅜ of an inch. Approximately the same radius was used for the drum indentation 15. Tensioning of the collar was effected with 5/16", 18 threads per inch screws (24) which were tightened to a torque of about 100 inch x pounds. The water filled receptacle assembly showed good handling characteristics when moved and handled with a parrot-beak chime-handling device. Generally it is desirable to use a drum wall thickness of at least about 0.125" most desirably between about 0.130 to about 0.150".

Figure 7:
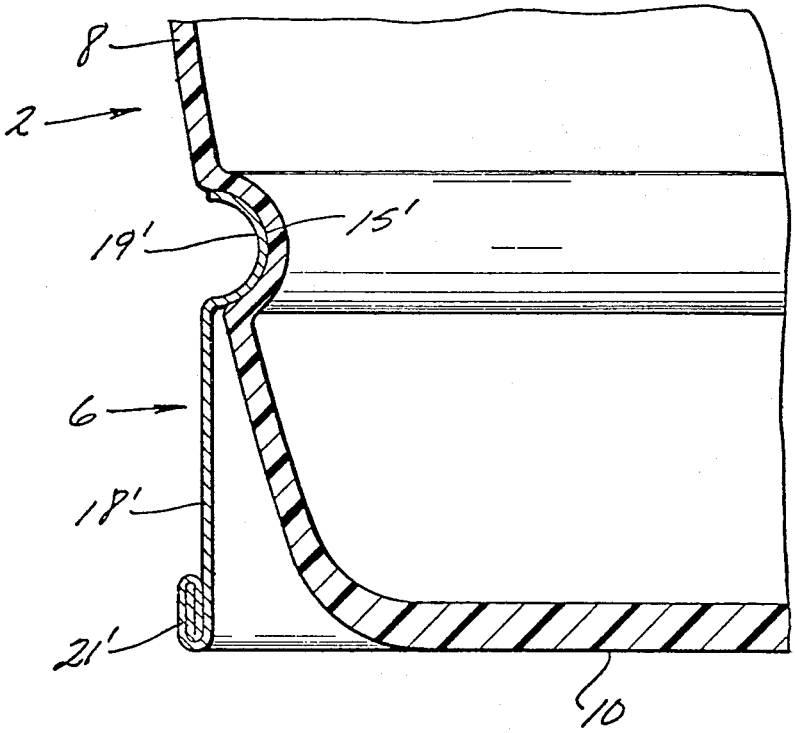
FIG. 7 is a fragmentary sectional view of a bottom portion of the receptacle assembly.

FIG. 7 illustrates the general configuration of the lower portion of the drum wherein handling means are likewise provided which handling means are grippable by steel drum chime-handling devices when the drum is in an inverted position and which handling means likewise povides a surface upon which the drum may be hand rolled when in a substantially upright position. As seen in FIG. 7 sidewall 8 includes a circumferential, generally horizontal inwardly projecting arcuate surface 15'. Collar 6 includes a vertical wall 18' which merges at its lower margin with a grippable chime-like projection 21'. The lower portion of collar 6 will generally be about flush with the bottom of the drum. The upper margin of wall 18' generally merges with a jog shown as an inwardly extending arcuate projection 19', with the inwardly extending projection 19' of collar 6 being in inter-engaging relationship with the corresponding inwardly extending arcuate projection 15' of drum 2. Collar 6, like collar 4, may be continuous or split and may be assembled to drum 2 in the manner described with regard to collar 4. Collar 6 may likewise be provided with an appropriate drainage channel to prevent the accumulation of liquids between the drum 2 and collar 6, such as for example as may occur when the drum is stored in an inverted position. Additionally if desired lower circumferential inwardly projecting surface 15' may if desired be provided with a drainage channel, or channels, in the manner of channel 17.

Figure 8:
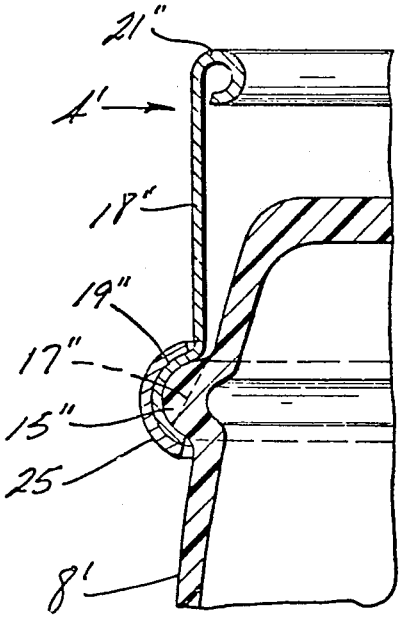
FIGS. 8 and 9 are fragmentary sectional views showing an alternate embodiment of the invention.

In another embodiment of this invention fragmentarily illustrated in FIG. 8, sidewall 8' of drum 2 is provided with horizontally disposed circumferential jog illustrated as an outwardly projecting surface 15" and assembled thereto is a collar 4'. Collar 4' includes a vertical wall 18" which merges at its upper margin with a grippable portion, such as bead-like portion 21" and wall 18" merges at its lower margin with an outwardly projecting portion 19". Projecting surface 15" of the drum and the projecting surface 19" of the collar are in a snug inter-engaging relationship. Contacting collar 4' and, more specifically, contacting projecting surface 19" is a tension band 25, which in the perferred embodiment will be a removable tension band. Exemplary of such a tension band is a conventional ring employed on open head fiber drums for securing the head to the body. As with the preferred embodiment previously described above, with respect to FIGS. 1–5, it is preferred that collar member 4' extend sufficiently upwardly such that its upper margin is at least about flush with the upper margins of the tubular projections which define the bung openings. As previously indicated either the drum or the handling means, or both, may be provided with an appropriate drainage channel for preventing the accumulation of water between the handling means and the drum. In FIG. 8, while it will be apparent that, preferably, a plurality will be employed, one drainage channel to accomplish that purpose is shown by the dotted line 17", which channel is formed in projection 15".

Figure 9:
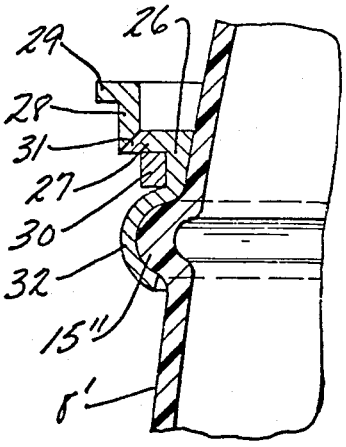

The fragmentary view of FIG. 9 represents still an alternate embodiment of this invention showing the drum sidewall 8' as likewise being provided with a substantially circumferential outwardly extending surface, portion 15". To the drum, as before, there is then assembled appropriate handling means. Here the handling means illustrated has a convex outwardly projecting portion 32 which inter-engages with projection 15" on sidewall 8', preferably in a forced, or interference, fit manner and projecting portion 32 merges with a first leg portion 26 shown here in substantially intimate contact with sidewall 8'. First leg portion 26 then merges with an outwardly extending shoulder portion 27, shoulder portion 27 in turn merging with a second leg portion 28 which in turn merges with an upper laterally projecting portion 29 so arranged and constructed as to allow steel drum handling devices, for example, a parrot-beak device, to grip same to allow movement and transportation of the drum. The under surface of the laterally projecting portion 29 provides a ledge to facilitate secure gripping by the jaws of a parrot-beak device. A tension band 30 will be employed to help retain the handling means in tight holding engagement with the drum. As shown tension band 30 is disposed in the reentrant zone defined by a portion of projection 32, shoulder 27, and first leg portion 26. In order to prevent the accumulation of liquids between the drum and the handling means illustrated in FIG. 9 a channel for drainage, such as that indicated at 31, generally formed in shoulder 27, may be employed, as indicated hereinbefore preferably a plurality of such channels will be distributed in a uniform circumferential pattern on the handling means. As contemplated in FIG. 9 the handling means for the drum need not extend sufficiently high to be at least flush with upper margins of the drum. It will be noted however that the laterally projecting portion 29 is sufficiently removed from the drum so as to allow parrot-beak jaws to pinchingly and grippingly engage the handling means without danger of such engagement with the drum, or drum wall, thereby precluding any possibility of puncturing the drum by the strong localized forces exerted by such jaws.

In passing it should be mentioned that preferably the inter-engaging jogs of the handling means and drum will be disposed at a location on the sidewall which is below, e.g. 1–3" beneath, what may be viewed as the annular edges of the drum. In this way the forces exerted on the handling means during handling and stacking of the drums will be uniformly distributed along a strong large section of the drum. Further, as indicated in the preferred embodiment, the handling means is at least flush with the upper margin of the drum top thus providing additional protection for the drum. Both of these characteristics result in extremely desirable drop and impace test results.

Figure 10:
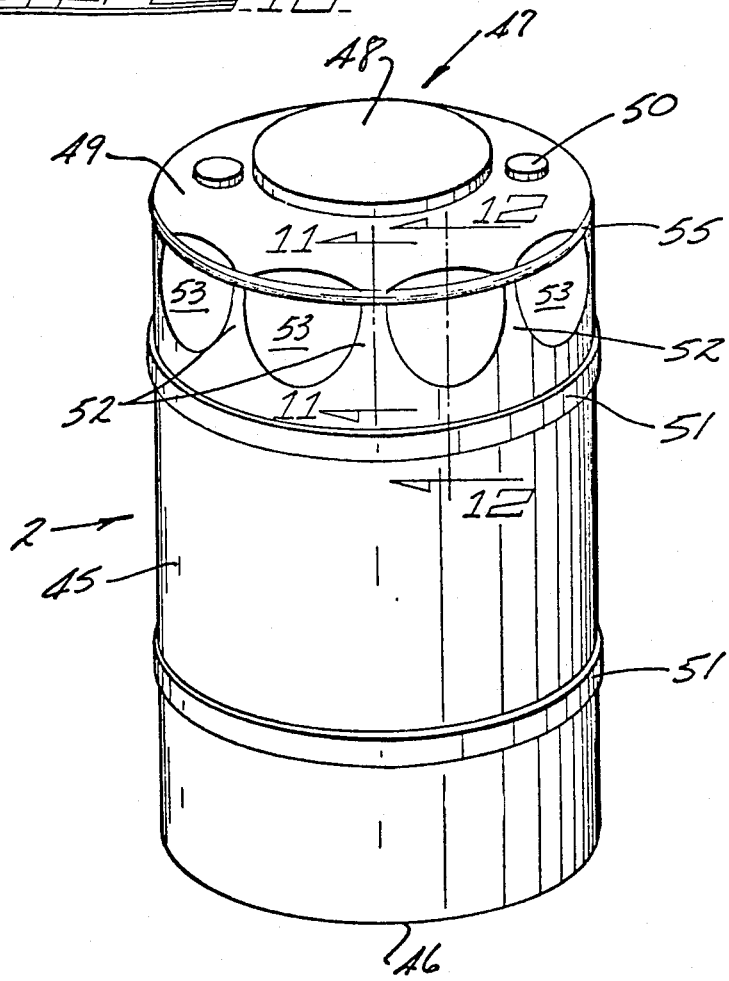
FIGS. 10–12 illustrate a further embodiment of the invention.
Figure 11:
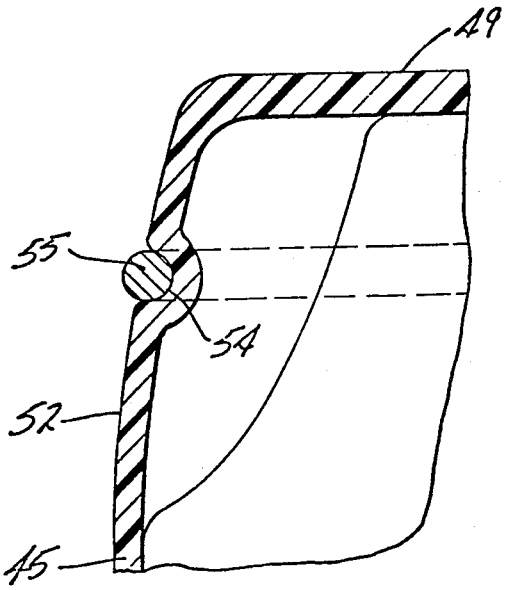
Figure 12:
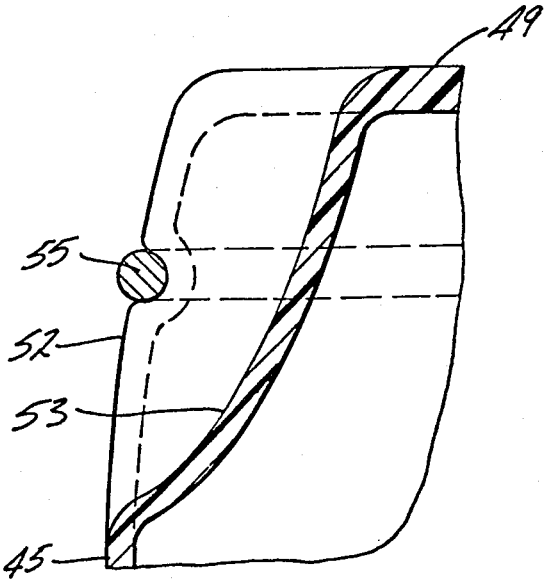

Referring now to FIGS. 10–12 another embodiment is illustrated. As seen in FIG. 10, a single piece blow molded plastic drum 2 is provided which drum has a circumferential sidewall 45 which merges at its lower margin with a bottom wall 46 and at its upper margin with a top wall generally designated 47. Top wall 47, not unlike the previously described embodiments, includes an upwardly extending panel 48 and depressed sections 49. Depressed top section 49 includes at least one and preferably two diametrically opposed tubular projections 50 which serve to define the bung openings into the drum. Sidewall 45 preferably also includes two axially displaced integrally blown projecting ribs 51 which function as rolling hoops for the drum. The drum will most advantageously be formed of high density polyethylene. The upper portion of sidewall 45 is generally of a substantially joggled configuration, i.e., a configuration having a plurality of integral circumferentially disposed outer surface portions 52 interspersed with a plurality of integral inwardly extending cavities 53. These cavities are arranged and constructed to provide hand grips on the drum and also serve to allow drainage of liquids. Substantially circumferentially about the drum, outer surface portions 52 of sidewall 45 are provided with an array of inwardly extending surface portions, or recesses 54 which are aligned at the same height on the drum. The assembled handling means grippable by chime-handling devices is illustrated as a continuous ring 55 tightly, e.g. by a press fit, engaging the recess array 54. In the embodiment illustrated inwardly extending cavities 53, and inwardly extending, projecting surfaces 54 along with ring 55 are so proportioned and arranged as to allow a steel drum chime-handling device, such as for example a parrot-beak device, to contact the externally disposed surface of ring 55 and then move into locking and gripping relationship with the ring for movement and transportation of the receptacle. That is, generally the radial distance between the internally disposed surface of ring 55 and the externally disposed surface of cavities 53 will be sufficient to allow the jaws of such devices to enter and grip the ring for movement and transportation of the drum without the jaws exerting any penetrating type pinching force upon the plastic drum itself. While the handling means of FIGS. 10–12 is shown as a simple ring which is arcuate in cross section it will, of course, be readily apparent great variation is possible. For example, the ring may take the form of a collar like that previously discussed, and the releasable mechanical means previously described for tensioning a collar may be employed.

I claim:

1. A plastic drum assembly for the storage, handling and shipment of materials, said assembly comprising, in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, and a circumferentially disposed collar member assembled to said drum, said collar member comprising a generally circumferentially disposed collar sidewall; said collar being at no point higher than said top end panel and terminating at its highest portion in a bead-like portion which merges with said collar sidewall at the top thereof and projects radially outwardly from said sidewall of said collar, and which is spaced apart from, and does at no point in its circumference touch, said drum and is thus adapted for gripping about substantially the full 360° of the collar circumference, by the opposed jaws of a steel drum chime-handling device having two opposed movable jaws to holdingly grip the collar with one jaw engaging the inside surface wall of the bead and the other jaw engaging the outer underside surface of the bead; and a radially inwardly disposed circumferential projection near its lower edge, said circumferential projection and said circumferential indentation being inter-engaged to retain said collar on said plastic drum while the drum is manipulated by such handling device which holdingly grips said collar.

2. An assembly of claim 1 wherein the top of the collar is disposed in substantially the same horizontal plane as the top of said top end panel.

3. A plastic drum assembly for the storage, handling and shipment of materials, said assembly comprising, in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, and a circumferentially disposed collar member removably assembled to said drum, said collar member comprising a generally circumferentially disposed collar sidewall;

a bead-like portion merging with said collar sidewall at the top thereof, projecting radially outwardly from said sidewall of said collar and being adapted for gripping at its upper edge by steel drum chime-handling devices about substantially the full 360° of the collar circumference; and a radially inwardly disposed circumferential projection at its lower edge, said circumferential projection and said circumferential indentation being inter-engaged as the sole means to retain said collar on said plastic drum while the drum is manipulated by such handling devices which holdingly grip said collar, said collar being in contact with said drum solely at said interengagement of said circumferential projection with said circumferential indentation.

4. A plastic drum assembly for the storage, handling and shipment of materials, said assembly comprising, in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, at least one channel formed in, and transverse to, said circumferential indentation for drainage of liquids from said top end panel while said drum is in upright position, and a circumferentially disposed collar assembled to said drum, said collar having at its upper edge an annular, radially outwardly projecting bead adapted for gipping by steel drum chime-handling devices about substantially the full 360° of the circumference, and an inwardly disposed circumferential projection at its lower edge, said circumferential projection snugly engaging said circumferential indentation to retain said collar on said plastic drum.

5. A plastic drum assembly for the storage, handling and shipment of materials, said assembly comprising, in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, and a circumferentially disposed collar removably assembled to said drum, said collar having at its upper edge an annular, radially outwardly projecting bead adapted for gripping by steel drum chime-handling devices about substantially the full 360° of the circumference, and an inwardly disposed circumferential projection at its lower edge, said circumferential projection snugly engaging said circumferential indentation to retain said collar on said plastic drum, said collar above said circumferential projection being nowhere in contact with the plastic of said drum, so that the only portion of said collar in contact with the plastic of said drum is said circumferential projection.

6. A plastic drum assembly according to claim 1 wherein the drum has at least one channel formed in, and transverse to, the circumferential indentation for drainage of liquids from said top end panel while said drum is in upright position.

7. A plastic drum assembly for the storage, handling and shipment of materials, said assembly comprising, in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, at least one channel formed in and transverse to, said circumferential indentation for drainage of liquids from said top end panel while said drum is in upright position, and a circumferentially disposed collar removably assembled to said drum, said collar being adapted for gripping at its upper edge for engagement with chime-handling devices about substantially the full 360° of the circumference, and an inwardly disposed circumferential projection at its lower edge, said circumferential projection engaging said circumferential indentation to retain said collar on said plastic drum.

8. A plastic drum assembly for the storage, handling and shipment of materials, said assembly comprising in combination, a single piece molded plastic drum having a top end panel, a bottom end panel and a circumferential sidewall merging with said top and said bottom end panels, said top end panel defining an opening, said circumferential sidewall including a circumferential indentation adjacent said top end panel, at least one channel formed in, and transverse to, said circumferential indentation for drainage of liquids from said top end panel while said drum is in upright position, and a circumferentially disposed collar removably assembled to said drum, said collar having at its upper edge an annular bead adapted for gripping by steel drum chime-handling devices about substantially the full 360° of the circumference, and an inwardly disposed circumferential projection at its lower edge, said circumferential projection engaging said circumferential indentation to retain said collar on said plastic drum.

* * * * *

UNITED STATES PATENT AND TRADEMARK OFFICE

CERTIFICATE OF CORRECTION

PATENT NO. : 4,489,847

DATED : December 25, 1984

INVENTOR(S) : Geoffrey C. Ames

It is certified that error appears in the above-identified patent and that said Letters Patent are hereby corrected as shown below:

Col. 5, line 21, "from" should be --form--; line 30, "inlude" should be --include--; Col. 7, line 29 "8" should be --18--; Col. 9, line23, "impace" should be --impact--; Claim 4, line 19, "gipping" should be --gripping--.

Signed and Sealed this

*Twenty-third* Day of *April 1985*

[SEAL]

*Attest:*

DONALD J. QUIGG

*Attesting Officer*

*Acting Commissioner of Patents and Trademarks*